US007483791B2

(12) United States Patent
Anderegg et al.

(10) Patent No.: US 7,483,791 B2
(45) Date of Patent: Jan. 27, 2009

(54) DETERMINATION OF SOIL STIFFNESS LEVELS

(75) Inventors: Roland Anderegg, Olten (CH); Dominik Von Felten, Aarau (CH)

(73) Assignee: Ammann Schweiz AG, Langenthal (CH)

( * ) Notice: Subject to any disclaimer, the term of this patent is extended or adjusted under 35 U.S.C. 154(b) by 0 days.

(21) Appl. No.: 10/572,568

(22) PCT Filed: Sep. 20, 2004

(86) PCT No.: PCT/CH2004/000592

§ 371 (c)(1),
(2), (4) Date: Jan. 16, 2007

(87) PCT Pub. No.: WO2005/028755

PCT Pub. Date: Mar. 31, 2005

(65) Prior Publication Data

US 2007/0276602 A1 Nov. 29, 2007

(30) Foreign Application Priority Data

Sep. 19, 2003 (EP) ..... 03405688

(51) Int. Cl.
*G01V 3/00* (2006.01)
*E01C 19/38* (2006.01)

(52) U.S. Cl. ..... 702/2; 404/117

(58) Field of Classification Search ..... 702/2, 702/1, 14, 16, 17; 73/78, 84, 784, 594, 12.12; 404/84.1, 122, 117; 405/271
See application file for complete search history.

(56) References Cited

U.S. PATENT DOCUMENTS

| | | | | |
|---|---|---|---|---|
| 2,952,193 | A * | 9/1960 | Converse | 404/113 |
| 3,865,501 | A * | 2/1975 | Kniep | 404/133.05 |
| 4,127,351 | A * | 11/1978 | Vural | 404/72 |
| 4,546,425 | A | 10/1985 | Breitholtz | |
| 4,734,846 | A * | 3/1988 | Konig | 700/33 |
| 5,695,298 | A | 12/1997 | Sandstrom | |
| 5,727,900 | A | 3/1998 | Sandstrom | |
| 6,213,681 | B1 * | 4/2001 | Sick et al. | 404/133.05 |
| 6,244,102 | B1 | 6/2001 | Novak | |
| 6,431,790 | B1 * | 8/2002 | Anderegg et al. | 404/75 |
| 7,089,823 | B2 * | 8/2006 | Potts | 74/553 |

FOREIGN PATENT DOCUMENTS

| | | |
|---|---|---|
| DK | 100 19 806 A1 | 10/2001 |
| DK | 100 28 949 A1 | 3/2002 |
| WO | WO-98/17865 A1 | 4/1998 |

OTHER PUBLICATIONS

Anderegg, R., Strassen Und Tlefbau, Giesel Verlag Fur, Publizitat. Isemhagen, DE, No. 12, 1997, pp. 11-17.

* cited by examiner

*Primary Examiner*—Michael P. Nghiem
*Assistant Examiner*—Toan M Le
(74) *Attorney, Agent, or Firm*—Birch, Stewart, Kolasch & Birch, LLP

(57) ABSTRACT

According to the invention, a single device permits the relative soil rigidity values of a section of soil to be determined in a rapid measuring method and in addition, absolute soil rigidity values to be determined in a slightly slower method. If the device is calibrated with the aid of the measured absolute values, a rapid absolute measurement can also take place. The device can also be used for soil compaction.

23 Claims, 7 Drawing Sheets

DETERMINATION OF SOIL STIFFNESS LEVELS

This application is the national phase under 35 U.S.C. § 371 of the PCT International Application No. PCT/CH04/00592, which has an international filing date of Sep. 20, 2004, and which claims priority under 35 U.S.C. § 119(a)-(d) of European Patent Office Application 0345688.7, filed Sep. 19, 2003.

TECHNICAL FIELD

The invention relates to a method and an apparatus for determination of soil stiffness levels, in which case this apparatus can also be used for soil compaction.

Particularly in civil engineering, there is a desire on the one hand to know before the work starts what the soil conditions are with respect to soil compaction to be carried out later; what soil compaction levels can be achieved; whether soil areas must be removed and possibly new material should be deposited, in order to achieve a predetermined soil compaction or predetermined load-bearing capability for road, railroad, airport runway construction, etc, at all.

On the other hand, when soil compaction has already been carried out, a compaction level which has already been achieved can be confirmed in order to guarantee required compaction levels to a customer. Furthermore, there is also a desire to know what the instantaneous compaction profile is, and whether further compaction is still possible at all with the available facilities. That is to say, can compaction be increased further by passing over it again with a vibration plate, a roller system, or a trench roller, etc.

PRIOR ART

In the German Laid-Open Specification DE-A 100 19 806, an attempt has been made to prevent "jumping" of a soil compaction apparatus (in particular in the case of a vibration plate) since this could result in loosening of already compacted soil and a rapid increase in machine wear. The harmonics of the oscillations excited by a soil compaction element were detected for this purpose. It was assumed that harmonics could occur as a result of a reaction of increased impact energy on soil that had already been compacted.

DE-A 100 28 949 proposed a system which was intended to be suitable for determination of the degree of compaction both during rolling and during plate shaking. A movement sensor was arranged on the upper body in order to measure vertical movement of the upper body. An amplitude value of a lower body oscillation at a maximum of 60% of the excitation frequency was determined relative to the upper body. The quotient of the abovementioned amplitude values was used as a measure for the current compaction level of the soil.

WO 98/17865 describes a soil compaction apparatus with an acceleration sensor on a roller drum. The compaction should be optimum, that is to say that it should be possible to complete it most quickly and with the minimum amount of energy being expended, when resonance of the soil compaction system occurred. The soil compaction system was formed from the soil to be compacted together with the compaction device acting on it.

U.S. Pat. No. 4,546,425 discloses how soil to be compacted became increasingly harder as it was passed over a plurality of times with the machine data remaining constant, and the compacting roller started to jump. A variable eccentric was used in order to prevent this jumping.

A method for monitoring a soil compaction process has been described in U.S. Pat. No. 5,695,298. The roller drum of the soil compaction apparatus was excited with a periodic, harmonic oscillation. Oscillations of a roller drum were determined by an accelerometer arranged on a holder and on this facing. The measurement signal attained was passed to a first bandpass filter for the excitation frequency (or higher frequencies) and to a second bandpass filter for half the excitation frequency. The output signal from the second bandpass filter (amplitude at half the excitation frequency) was divided by a division circuit by the output signal from the first bandpass pass filter (amplitude at the excitation frequency). The quotient should not exceed a predetermined value, for example 5%, in order to ensure that stable work was still possible, avoiding unstable states.

U.S. Pat. No. 5,727,900 describes a monitoring device for a soil compaction apparatus, and a method for measurement of soil stiffness. In this case, the horizontal and vertical acceleration values of a roller drum on a soil compaction apparatus, the position of the eccentric, the eccentricity of the eccentric and the rolling speed of the compaction apparatus were measured as measurement data. A method was specified as to how an excitation frequency can be set for a vibrator when being driven over one and the same soil area a plurality of times.

The soil stiffness was determined using an equation $f=f_{nom}(G/G_{nom})^q$, where G was the shear modulus of the soil, and f was an excitation frequency to be set, while q was an empirical value. This resulted in an optimum compactor frequency $f_{nom}$, for predetermined soil compaction. $G_{nom}$ was a typical shear modulus of the compacted soil. G and q were current soil data, with G increasing and q decreasing during the compaction process.

The article by R. Anderegg in "[The Road and Construction Engineering]" (No. 12/1997) describes dynamic compaction monitoring over an area for road vibration rollers, with a monitoring system being used to monitor ongoing compaction work and rechecking of complete compaction work. The roller and the soil together form an oscillating system. The roller drum is excited by an unbalance rotating at one frequency. It is found that, as the compaction of the soil increases, the roller drum lifts off the soil, thus resulting in harmonics; a first subharmonic oscillation occurs if compaction is continued.

The excitation frequency is set to a resonant frequency to be expected of the oscillating system comprising of "compaction apparatus—soil with required compaction". The natural frequency of the oscillating system thus increases as the compaction increases and then moves into the vicinity of the natural frequency, resulting in an increase in the maximum soil reaction force. In order to allow the soil compaction that has been achieved to be assessed, the amplitude ratio of the first harmonic to the excitation frequency and the first subharmonic to the excitation frequency is considered. The greater this ratio, the greater the achieved compaction level should be.

U.S. Pat. No. 6,244,102 B1 relates to a method for determination of the compaction level of soil areas having one layer and in particular more than one layer. For this purpose, the weight per unit area of a layer that had been compacted to the desired extent was determined first of all. In addition, the effectively oscillating mass of a soil compaction device-earth layer-subsoil system and the natural frequency of the system for the desired compaction were determined. The compaction level should now be determined from the ratio between a measured oscillation frequency of the system and the determined natural frequency. In order to carry out the method, the soil compaction device had sensors for measuring the frequency, amplitude, acceleration and further values, and these sensors were connected via an interface to a computer. The computer evaluated the measured values and produced optimum parameters for the further compaction process, so that the amplitude, the frequency, the mass of the unbalance, etc, could be adapted. The operating frequency of the apparatus was set to a value close to the resonant frequency.

DESCRIPTION OF THE INVENTION

Object

The object of the invention is to indicate a method and to provide an apparatus by means of which relative as well as absolute soil stiffness values can be determined quickly and in a simple manner over a soil surface.

Solution

The object was achieved with regard to the method by the features of patent claim 1, and with regard to the apparatus by the features of patent claim 8.

The essence of the invention, as can be seen from FIG. 1, is the use of only a single machine (apparatus) for absolute measurements and relative measurements of soil compaction levels and for soil compaction. The absolute measurements require a certain amount of time in order to set resonance of an oscillating system, formed from the vibration unit and the soil area on which the vibration unit is in continuous contact with the soil surface. The determination of relative values is a fast method; the values are obtained directly while passing over the soil surface. If this machine is calibrated for a defined soil composition (loam, sand, gravel, loamy soil with a predetermined gravel/sand component, . . . ) in accordance with a method as described below, then absolute values of the soil compaction (soil stiffness) can also be determined while actually passing over it.

Since this machine has a vibration unit with a periodic excitation force, it is, of course, also possible to use it for ground compaction.

The determination according to the invention of relative values of the compacted soil or of the soil to be compacted is, according to the invention, an extremely fast process. This makes it possible to determine where the soil has already been compacted well and where it has been compacted less well. It is thus also possible to estimate whether the soil compaction can be increased further by passing over it again, or whether a soil compaction level that has already been achieved (achieved soil stiffness) can or cannot be increased significantly further with the available means.

An absolute soil stiffness level has been determined by means of a standardized, so-called known plate pressure test. During this plate pressure test, a plate with a diameter of 30 cm has a predetermined compression force applied to it, and the sinkage is measured. This is a static process. This measurement method is defined by the standards and requires effort to carry it out. The absolute compaction level is always determined at predetermined points, that is to say on a point-specific basis. Once an absolute value has been determined at one point once, all that is then generally of interest is the compaction profile in the surrounding area.

The invention now proposes that the vibration unit that is provided for the relative measurement also be used to carry out the absolute measurement. In order to carry out both an absolute measurement and a relative measurement of soil compaction levels or soil stiffness levels, only the force which acts on the vibration unit and varies with time is varied.

As will be described in more detail in the following text, the relative values are determined by determining a plurality of subharmonics from the oscillation form of the oscillating system when an operating frequency is applied to the vibration unit, and by determining that subharmonic with the lowest frequency from all of the subharmonics of the operating frequency, with the soil stiffness being higher the lower the frequency of the lowest subharmonic. The vibration unit is in this case in a so-called "chaotic oscillation state".

The absolute values are determined by operating the vibration unit in the surcharge mode, as described below.

The "chaotic oscillation state" and the "surcharge mode" of the vibration unit differ only in a force whose values vary, which varies with time and which acts on the vibration unit.

In simple terms, this means that the time-variable force on the vibration unit during an absolute measurement is such that the vibration unit oscillates at resonance on the soil surface, and is always in contact with the soil. During a relative measurement, in contrast, the vibration unit jumps, that is to say it lifts off the soil and, as a consequence of being lifted off, can easily be moved over the soil surface while at the same time measuring relative soil compaction levels and the relative soil stiffness. Relative values which characterize the compaction state are obtained directly while passing over the soil.

For absolute measurement, a time-variable excitation force is produced on the vibration unit as a periodic first force with a maximum, first oscillation value which is directed vertically against the soil surface. The frequency of the excitation force or its period is set or adjusted in such a way that an oscillating system, formed from the vibration unit and a soil area which is to be compacted and/or to be measured and which is in continuous surface contact with the vibration unit, starts to resonate. The resonant frequency f is recorded and stored. Furthermore, a phase angle $\phi$ between the occurrence of a maximum oscillation value of the excitation force and a maximum oscillation value of an oscillation response of the oscillating system mentioned above is determined.

If, for example, a vibration plate is used, then the oscillating mass $m_d$ of the vibrating body is known, and a static moment $M_d$ of an unbalance exciter is also known, in which case all of the oscillating unbalances must be taken into account. In addition to the phase angle $\phi$, the amplitude A of the vibrating body is measured. An absolute soil stiffness $K_B$ [MN/m], can be determined from the oscillating mass $m_d$ [kg·m], the resonant frequency f [HZ], the static moment $M_d$ [kg·m], the amplitude A [m] and the phase angle $\phi$ [°] using the following relationship:

$$k_B=(2\cdot\pi\cdot f)^2\cdot(m_d+\{M_d\cdot\cos\phi\}/A) \qquad \{A\}$$

A modulus of elasticity of the relevant piece of soil can be determined from the determined soil stiffness $k_B$ (applicable to both absolute and relative values) using the following formula:

$$E_B[MN/m^2]=k_B\cdot \text{Form factor}$$

The form factor can be determined by continuum-mechanical analysis of a body which is in contact with an elastic semi-infinite space, in accordance with "[Research in the field of Engineering]", Volume 10, September/October 1939, Nr. 5, Berlin, pages 201-211, G. Lundberg, "[Elastic Contact Between Two Half-Spaces]".

In order to determine relative values, with this being a fast process, excitation force is increased until the vibration unit starts to jump. The excitation frequency will generally be chosen to be above resonance; however, it is also possible to operate at the resonant frequency or below resonance; in this case, the unbalance must be varied as appropriate.

In addition, the excitation force is now no longer applied at right angles to the soil surface but in such a way that the apparatus with the vibration unit is moved autonomously over a soil surface, and now just has to be steered in the desired direction by a vibration plate operator. The measurement means of the apparatus are in this case designed in such a way that just a frequency analysis of the oscillation response on the vibration plate is carried out. A lowest subharmonic oscillation with respect to the excitation frequency is determined by means of filter circuits. The lower the lowest subharmonic oscillation, the greater is the soil compaction that has been achieved. The measurement can be further refined by determining amplitude values in the oscillation response for all subharmonic oscillations, and by determining a first harmonic of the excitation frequency. These amplitude values are related to the amplitude values of the excitation frequency, using weighting functions, in accordance with the following equation:

$$s=x_0 \cdot A_{2f}/A_f+x_2 \cdot A_{f/2}/A_f+x_4 \cdot A_{f/4}/A_f+x_8 \cdot A_{f/8}/A_f \qquad \{B\}$$

$x_0$, $x_2$, $x_4$ and $x_8$ are weighting factors, whose determination is described below. $A_f$ is the maximum oscillation value of the excitation force acting on the vibration unit. $A_{2f}$ is the maximum oscillation value of a first harmonic of the excitation oscillation. $A_{f/2}$ is a maximum oscillation value of a first subharmonic at half the frequency of the excitation oscillation. $A_{f/4}$ and $A_{f/8}$ are maximum oscillation values of the second and third subharmonic, respectively, at a quarter of the frequency and at an eighth of the frequency, respectively, of the excitation oscillation. $A_{2f}$, $A_{f/2}$, $A_{f/4}$ and $A_{f/8}$ are determined from the oscillation response.

The higher the value of s now is, the higher is the soil compaction, as well. Since maximum oscillation values and their relationships with a sum being formed would have to be determined just for assessment of the soil compaction, this is an extremely fast measurement process.

If the weighting values mentioned above are now determined, then an absolute measurement follows from the relative measurement, with the process of obtaining absolute values always being linked to one and the same soil composition (see as already stated above (loam, sand, gravel, loamy soil with a predetermined gravel/sand component, . . . )).

The determined values s can now be passed to associated indicator lights, depending on the different value level. It is thus possible to see at a glance when passing over soil subareas of a soil area of predetermined soil composition what the profile of the soil compaction level is. If a roller system, etc is used for measurement purposes after each compaction process, for example by means of a trench roller, then any increase in compaction can be determined. If the compaction increase is only minor, or if no compaction increase is determined, a further pass will not result in a further increase in compaction, either. If, despite this, a further increase in compaction is required, different compactor means must be used, or the soil composition must be changed by material replacement.

Since both absolute measurements and fast relative measurements of the soil compaction can be carried out by means of the apparatus described here, it is possible, as stated in the following text, to also carry out fast absolute measurements after a calibration process. On the basis of the above equation {A} it is possible to determine the absolute soil stiffness $k_B$ [MN/m] of a soil subarea if the following "machine parameters" are known: oscillating mass $m_d$ of the lower body and static moment $M_d$ of an unbalance exciter, if a vibration plate is being used, and a measurement of the oscillation amplitude A of the lower body, the resonant frequency f [Hz] and the phase angle $\phi$ [°].

Soil stiffness levels $k_{B1}$, $k_{B2}$, $k_{B3}$ and $k_{B4}$ are now determined, corresponding to the four weighting factors $x_0$, $x_2$, $x_4$ and $x_8$ in equation {B} on four different soil subareas of the soil area, in each case by means of an absolute measurement, in which case different soil stiffnesses should result for the same soil composition.

After determination of the soil stiffness levels $k_{B1}$, $k_{B2}$, $k_{B3}$ and $k_{B4}$ the maximum oscillation values $A_f$, $A_{2f}$, $A_{f/2}$, $A_{f/4}$ and $A_{f/8}$ are determined on the same four soil subareas. The values obtained are inserted into the equation {B}, with the soil stiffness levels, $k_{B1}$, $k_{B2}$, $k_{B3}$ and $k_{B4}$ being used for s. These results in four equations, from which the four still unknown weighting factors can be determined.

If these values are stored in a memory for an evaluation unit of the apparatus described below, then only the maximum oscillation values $A_f$, $A_{2f}$, $A_{f/2}$, $A_{f/4}$ and $A_{f/8}$ now need to be determined by passing over soil subareas, and may be linked to the weighting values in order to obtain absolute soil stiffness levels. An absolute measurement can now be carried out just as quickly as the relative measurements mentioned above.

If the soil composition changes, then relative measurements can still be carried out; however, a recalibration process should be carried out. Weighting values for different soil compositions can be stored in a memory for the apparatus, and measurements can be carried out within a tolerance which is governed by the soil composition. However, a calibration process should always be carried out when the soil compositions change, in order to obtain sufficient accuracy. A calibration process is admittedly significantly slower than the fast relative measurement; however, a calibration process can be carried out in a few minutes with some practice.

The determined soil compaction levels are preferably stored together with the respective position coordinates of the measurement and are at the same time transmitted to a control center, for example to a construction site office, in order that appropriate steps can be planned and/or ordered for required compaction machines or work on the soil. Instead of being transmitted to a physically remote control center, they can also be transmitted to a roller operator who is currently carrying out soil compaction on the soil area being measured at that time, with the measured values indicating to him whether further compaction operations could still lead to an increase in the soil stiffness. Both the absolute and the relative soil level can, of course, be indicated and displayed directly on the vibration plate being used for measurement purposes.

A vibration plate will preferably be used as the vibration unit, since this is a low-cost product. However, it is also possible to use other machines, a trench roller and a single drum roller. However, the vibration plate has the advantage that the contact area with the soil surface is defined.

Two unbalances driven in opposite directions are preferably used as the excitation force. The position of the two unbalances with respect to one another must be variable in order on the one hand that the excitation force can be directed at right angles onto the soil surface (for a calibration process and for an absolute measurement), and on the other hand, directed obliquely backwards, in the opposite direction to the movement direction. The frequency of the excitation force, (in this case, by way of example, the counter rotating speed of revolution of the unbalances) must also be variable in order to allow resonance to be achieved. The resonant frequency can be searched for manually; however, it can advantageously be carried out by means of an automatic "scanning" process, which starts to oscillate at the resonant frequency.

The static unbalance moment could also advantageously be designed to be variable, for example, by the capability to adjust the unbalance mass or masses radially.

In contrast to the known soil compaction methods, and the known soil compaction apparatuses, the invention does not attempt to eliminate subharmonics of the excitation frequency (operating frequency). In contrast, they are deliberately evaluated. This is because use is made of the knowledge, as explained in the detailed description, that the frequencies of the subharmonics define a soil compaction level that has been achieved. The lower the frequency of the lowest subharmonic, the greater is the soil compaction level over which a soil contact unit of a soil compaction apparatus is being moved.

The soil contact unit which is in contact with the soil to be compacted or which has already being compacted can now have applied to it the force of a single sinusoidal oscillation, in general by means of a revolving eccentric or by means of two eccentrics whose angles with respect to one another can be adjusted. However, it is also possible to use a plurality of eccentrics revolving at different frequencies. A range of subharmonics are then produced for each of these frequencies, depending on the soil compaction level achieved. If a plurality of "fundamental frequencies" are used, it is possible to make a more detailed statement about the soil compaction that has been achieved and/or is to be measured.

However, the operating frequency for the soil contact unit is preferably selected such that it is variable. This is because a variable frequency makes it possible to determine a resonance of the oscillating system comprising the soil contact unit and the soil area which is to be compacted or which has been compacted. Operation at resonance results in compaction with a reduced compaction power level. Since the oscillating system is a damped system because of the compaction power that needs to be applied, the degree of damping results in a phase angle between the maximum amplitude of the excitation (for example the force from the rotating unbalances) and the oscillation of the system (oscillation of the soil contact unit). In order to allow this phase angle to be determined, a sensor which measures the time deflection in the soil compaction direction is fitted to the soil contact unit, in addition to a sensor for the subharmonics (as well as for the resonant frequency and harmonics). The time deflection of the excitation (force applied to the soil contact unit) can likewise be measured; however, this can easily be determined from the instantaneous position of the unbalance or unbalances. The timing of the maximum amplitudes (excitation oscillation with respect to the oscillation of the soil contact unit) is determined by means of a comparative unit. The excitation is preferably set in such a way that the maximum amplitude of the excitation leads the maximum amplitude of the soil contact unit by 90° to 180°, preferably about 95° to 130°. The values determined in this case may be used, as described below, for determination of absolute compaction levels as well, provided that the excitation frequency is variable.

The maximum amplitude of the excitation force is preferably also designed to be variable. The excitation force can be adjusted, for example, when using two unbalances which rotate at the same speed of revolution but whose angular separation is variable. The unbalances can be moved in the same direction or else in opposite directions.

In addition, it should be noted that the occurrence of subharmonics can lead to machine damage if a soil compaction apparatus which has a soil contact unit is not appropriately designed. Damping elements are therefore installed between the respective soil contact unit and the rest of the machine parts in such a way that any transmission of subharmonics is damped. The entire soil compaction unit may, of course, be designed in such a way that low-frequency subharmonics do not cause any damage; their frequency is known on the basis of the statements in the detailed description. However, the amplitude of the excitation force can also be reduced to such an extent that the amplitudes of the subharmonics do not cause any damage, or are no longer present.

Further advantageous embodiments and feature combinations of the invention will become evident from the following detailed description and from the totality of the patent claims.

BRIEF DESCRIPTION OF THE DRAWINGS

In the drawings which are used to explain the exemplary embodiments.

In principle, identical parts and elements in the figures are provided with the same reference symbols.

APPROACHES TO IMPLEMENTATION OF THE INVENTION

Figure 1:
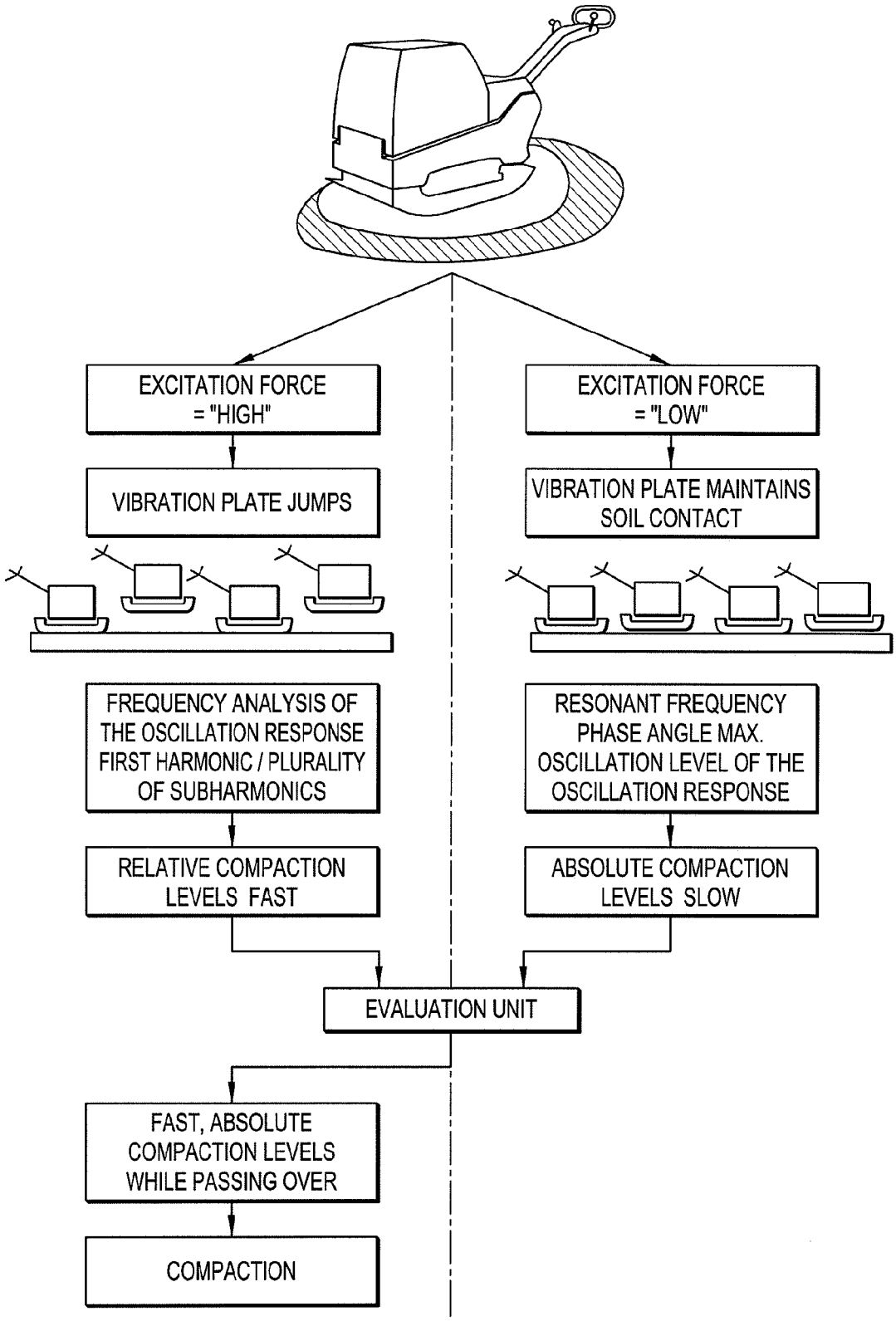
FIG. 1 shows a schematic illustration in order to explain the invention.
Figure 2:
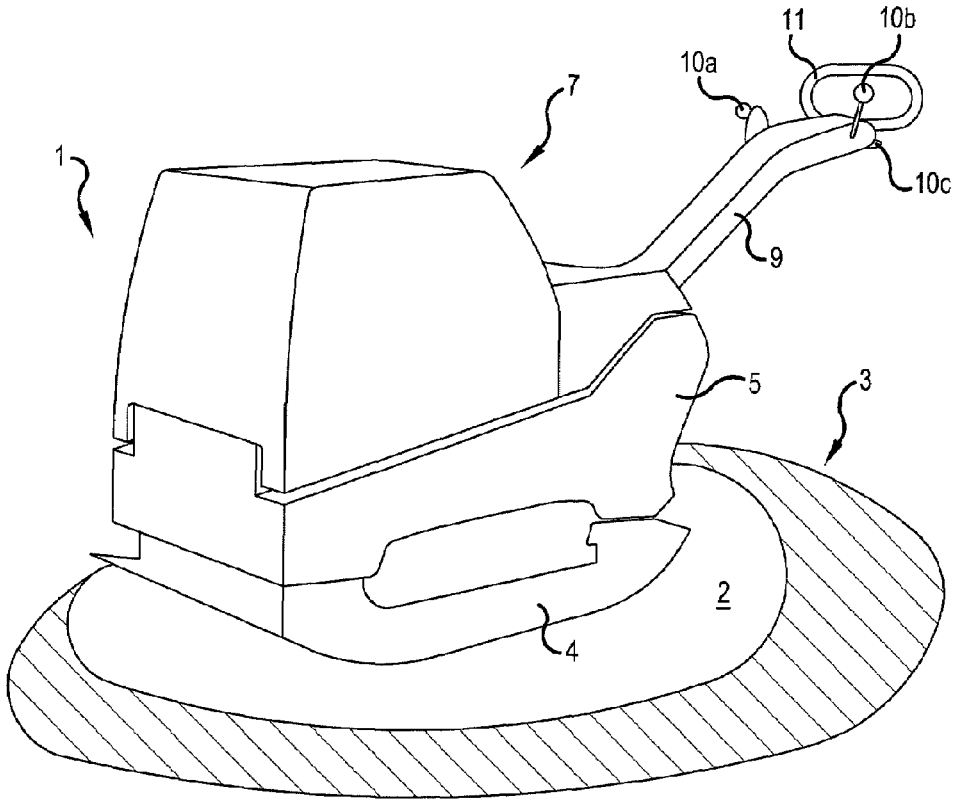
FIG. 2 shows a schematic illustration in order to explain an analytical model of a system which can oscillate and has, for example, a vibration plate and a soil area to be compacted or which is being compacted.

In an analytical description of dynamic soil compaction apparatuses, consideration of a soil contact unit together with the compacted soil or soil to be compacted as a single system plays a central role. In this context, FIG. 2 shows a vibration plate 1 with a base plate 4 of a vibrating body 5, which is contact with a soil surface 2 of a soil subarea 3 which is being compacted or is to be compacted, of a soil area. The base plate 4 represents a soil contact unit. The vibrating body 5 is connected to a dead weight body 7 via vibration-damping elements 6, and a control shaft 9 is arranged on the dead weight body 7. In the "jumping" state, as described, the vibration plate 1 can be moved over the soil area including the soil surface 2, by means of the control shaft 9. Adjusting elements 10*a*, 10*b* and 10*c* are arranged on the control shaft 9, by means of which a static unbalance moment $M_d$, an excitation frequency f and an angle $\alpha$ of a resultant force acting on the soil surface 2 can be varied. The control shaft 9 also has a safety element 11, which in this case by way of example is in the form of an oval ring, and in the illustrated position allows only a no-load unbalance moment to act on the base plate 4. The no-load unbalance moment is set to be sufficiently small that the vibration plate 1 cannot move in the horizontal direction over the soil surface 2.

The main reason for the occurrence of the non-linear effects described in the following text is a link on one side between a soil subarea 3 (structure underneath) that has to be measured and/or to be compacted and the vibration plate 1 (compaction and/or measurement appliance). The link on one side is because of the fact that compression forces can be transmitted between the appliance 1 and the soil subarea 3, but tensile forces cannot. This is therefore a force-controlled non-linearity; the appliance 1 loses contact with the soil subarea 3 (the ground underneath) periodically when maximum soil force levels are exceeded. Additional non-linear elements of the soil characteristics, such as stiffness changes controlled by shear stresses, can, in comparison to this, be ignored. A more than linear spring characteristic of (rubber) damping elements 6 between the vibrating body 5 and the dead weight body 7 is also of secondary importance, and does not significantly influence the calculation results of an analytical description.

As a compaction appliance or measurement appliance, the vibration plate 1 in general has a soil contact unit (vibrating body 5 with the base plate 4) with two unbalances 13*a* and 13*b* (FIG. 2), which rotate in opposite directions and have a total mass $m_d$, which also includes an unbalance exciter. The entire excitation inducing oscillating mass is symbolized by $m_d$. A static loading weight of the dead weight body 7 with a mass $m_f$ (static weight) is supported on the vibrating body 5 via damping elements 6 (stiffness $k_G$, damping $c_G$). The static weight $m_f$ together with the damping elements 6 results in an oscillating system which is excited at its foot point and is tuned to a low frequency (a low natural frequency). The dead weight body 7 acts as a second-order low-pass filter with respect to the oscillations of the vibrating body 5 in the vibration mode. This minimizes the amount of vibration energy transmitted to the dead weight body 7.

The soil of the soil area 3 which is to be measured, is to be compacted or has been compacted is a substance for which different models exist, depending on the characteristics being investigated. Simple spring/damper models (stiffness $k_B$, damping $c_B$) are used in the case of the system mentioned above (soil contact unit—soil). The spring characteristics take account of the contact zone between the soil compaction unit (vibrating body 5) and the elastic half-space (soil area). In the region of the excitation frequencies of the appliance mentioned above, which are above the lowest natural frequency of the system (soil contact unit—soil), the soil stiffness $k_B$ is a steady-state variable, which is not dependent on the frequency. It was possible to verify this characteristic in the application under consideration here in a field trial for homogenous and stratified soils.

If the appliance model and the soil model are joined together taking into account the link on one side to form an overall model, the following equation system (1) describes the associated differential equations of motion for the degrees of freedom $x_d$ of the lower body 5 and $x_f$ of the upper body 7.

$$m_d\ddot{x}_d + F_B + c_G(\dot{x}_d - \dot{x}_f) + k_G(x_d - x_f) = M_d\Omega^2\cos(\Omega\cdot t) + m_d g \qquad (1)$$

$$m_f\ddot{x}_f + c_G(\dot{x}_f - \dot{x}_d) + k_G(x_f - x_d) = m_f g$$

On the basis of a soil-force-controlled, unilateral contact, this results in:

$$F_B = c_B\dot{x}_d + k_B x \text{ for } F_B > 0$$

$$F_B = 0 \text{ else}$$

$m_d$: oscillating mass [kg], for example vibrating body 5

$m_f$: steady-state load weight [kg], for example dead weight body 7

$M_d$: steady-state moment unbalance [kg m]

$x_d$: movement, oscillating mass [mm]

$x_f$: movement, load weight [mm]

$\Omega$: excitation circular frequency $[s^{-1}]\Omega = 2\pi\cdot f$ f: excitation frequency [Hz]

$k_B$: stiffness of the ground underneath/soil area [MN/m]

$c_B$: damping of the ground underneath/soil area [MNs/m]

$k_G$: stiffness of the damping elements [MN/m]

$c_G$: damping of the damping elements [MNs/m]

The non-linearity of the unilateral contact is in this case controlled by a soil reaction force $F_B$ between the vibrating body 5 and the soil area 3 to be measured which might be compacted or which has been compacted.

The analytical solution of the differential equations (1) is in the following general form:

$$x_d = \sum_j A_j\cos(j\cdot\Omega\cdot t + \varphi_l) \qquad (2)$$

j=1 linear oscillation response, load operation j=1,2,3, . . . periodic lifting off (the machine loses contact with the soil once in each excitation period)

j=1, ½, ¼, ⅛, and associated harmonics: jumping, tumbling, chaotic operating state.

The following analyses of "jumping" are based on the assumption of a force $F_B$ acting at right angles on the soil surface 2. In the case of the vibration plate described above, in contrast, this force does not act on the soil surface 2 at right angles, but obliquely backwards, in order, for example, to create a jumping movement in the forwards direction. The vertical component of the oblique force should thus be used in the following mathematical analyses. The excitation force which acts obliquely on the soil surface is achieved by the unbalances 13*a* and 13*b* which rotate in opposite directions being shifted in terms of rotation with respect to one another in such a way that the added unbalance moments of the unbalances 13*a* and 13*b* have a maximum force vector approximately at an angle of 20° to the right downwards in FIG. 3. In order to determine the absolute values (resonance case), the maximum force vector (which will be identical to those $F_B$) points at right angles to the soil surface 2.

A numerical simulation allows the calculation of the solutions of the equations (1). The use of numerical solution algorithms is essential in particular for verification of chaotic oscillations. Very good approximate solutions and statements of a fundamental nature relating to the bifurcation of the fundamental oscillations can be made for linear and non-linear oscillations with the aid of analytical calculation methods, such as the averaging method. The averaging theory is described in Anderegg Roland (1998), "[Non-Linear Oscillations in Dynamic Soil Compactors]", VDI progress reports, Series 4, VDI Verlag Dusselfdorf. This allows a good overall view of the solutions that occur. In systems with a plurality of branches, analytical methods are associated with an excessively high level of complexity.

The Mathlab/Simulink® program pack is used as a simulation tool. Its graphics user interface and the available tools are highly suitable for dealing with the present problem. The equations (1) are first of all transformed to a dimensionless form in order to ensure that the results have the maximum possible generality.

$$\text{Time: } \tau = \omega_0 t;\ \omega_0 = \sqrt{k_B / m_d}$$

$$\text{Resonance ratio: } \kappa = \frac{\Omega}{\omega_0}$$

$$\text{where } \Omega = 2\pi \cdot f$$

That is to say $\kappa = f/f_0$, where f is the excitation frequency and $f_0$ is the resonant frequency [Hz].

And $\omega_0$ is the circular resonant frequency of the "machine-soil" oscillating system [$s^{-1}$].

$$\text{Location: } \eta = \frac{x_d}{A_0};\ \varsigma = \frac{x_f}{A_0};\ \eta'' = \omega_0^2 \eta;\ \varsigma'' = \omega_0^2 \varsigma; \tag{3}$$

Amplitude $A_0 f$ is freely variable $$\text{Material characteristic } s\text{: } \delta = \frac{c_B}{\sqrt{m_d k_B}} = 2d_B;\ \lambda_c = \frac{c_G}{c_B};$$

$$\lambda_k = \frac{k_G}{k_B};$$

$$\text{Masses and forces: } \lambda_m = \frac{m_f}{m_d};\ A_{th} = \frac{m_u r_u}{m_d};\ \gamma = \frac{A_{th}}{A_0};$$

$$f_B = \frac{F_B}{k_B \cdot A_0} = k_B A_0 (\eta + \delta\eta');$$

$$\eta = \frac{x_d}{A_0};\ \eta_0 = \frac{m_d \cdot g}{k_B A_0};\ \varsigma_0 = \frac{m_f \cdot g}{k_B A_0};$$

$$\eta'' + f_B + \lambda_c \delta(\eta' - \varsigma') + \lambda_k(\eta - \varsigma) = \gamma\kappa^2 \cos(\kappa\tau) + \eta_0$$

$$\lambda_m \varsigma'' + \lambda_c \delta(\varsigma' - n') + \lambda_k(\varsigma - \eta) = \varsigma_0$$

$$\text{where } f_B = \begin{cases} \delta\eta' + \eta & \text{if } f_B > 0 \\ 0 & \text{else} \end{cases}$$

Figure 4:
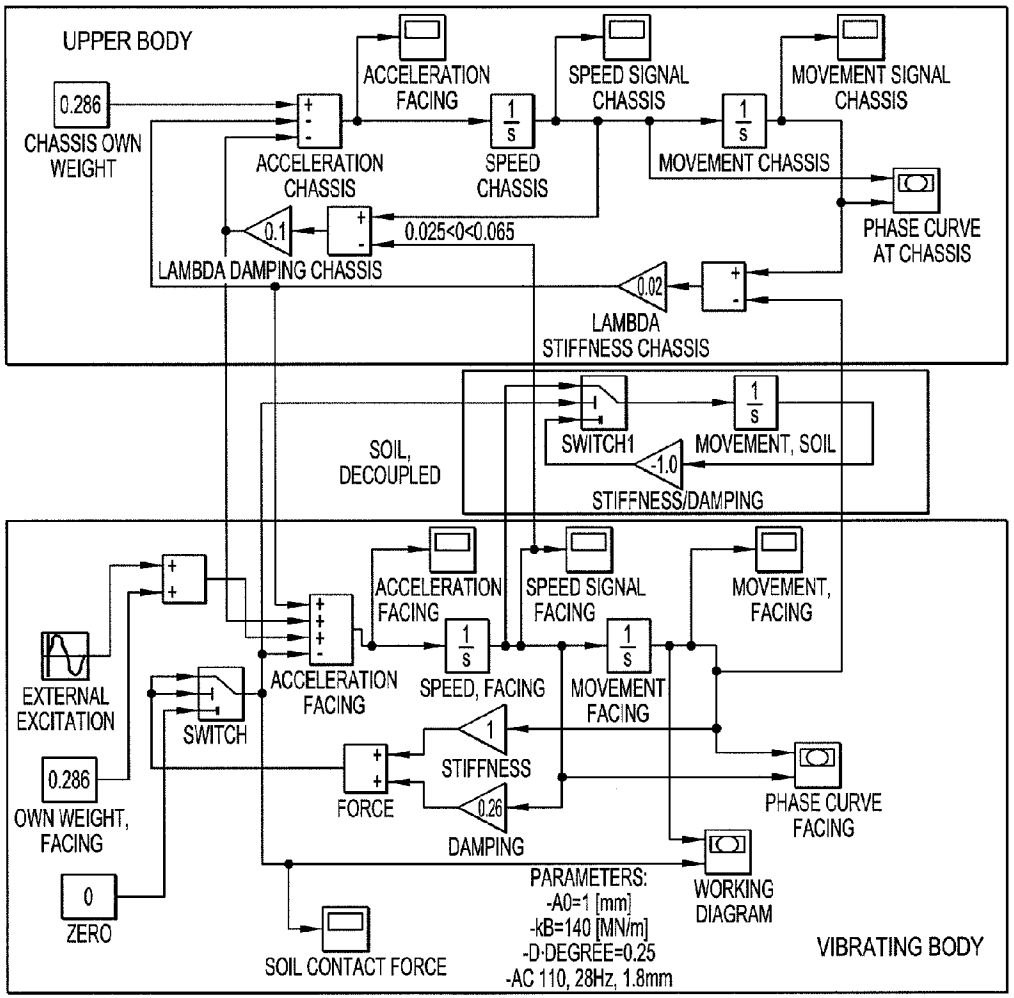
FIG. 4 shows an example of an implementation of a dimensionless model in a Simulink model.

The resultant equations (3) are modeled in graphics form using Simulink®, see FIG. 4. The non-linearity is considered in a simplified form as a purely force-controlled function and is modeled with the aid of the "Switch" block from the Simulink® Library.

The coordinate system for the equations (1) and (3) includes a static depression as a result of the intrinsic weight (static load weight $m_f$, oscillating mass $m_d$).

In comparison with measurements which result from integration of acceleration signals, the static depression must be subtracted for comparison purposes in the simulation result. The initial conditions from the simulation are all set to "0". The results are quoted for the steady state case. An "ode 45" (Dormand-Price) with a variable integration step width (maximum step width 0.1 s) in the time period from 0 s to 270 s is chosen as the solution solver.

For analysis of the chaotic machine behavior of the vibration plate 1, it is generally sufficient to investigate the oscillating part. Particularly in the case of well-matched rubber damper elements, the dynamic forces in the elements (lower body and upper body) are negligibly small in comparison to the static forces and: $\ddot{x}_f \ll \ddot{x}_d$. In this case, the two equations in (1), and (3) can be added, resulting in an equation (4a) for one degree of freedom of the oscillating element $x_d \equiv x$. The associated analytical model is shown in FIG. 3.

$$F_B = -m_d \ddot{x} + M_d \Omega^2 \cos(\Omega \cdot t) + (m_f + m_d) \cdot g \tag{4a}$$

Figure 3:
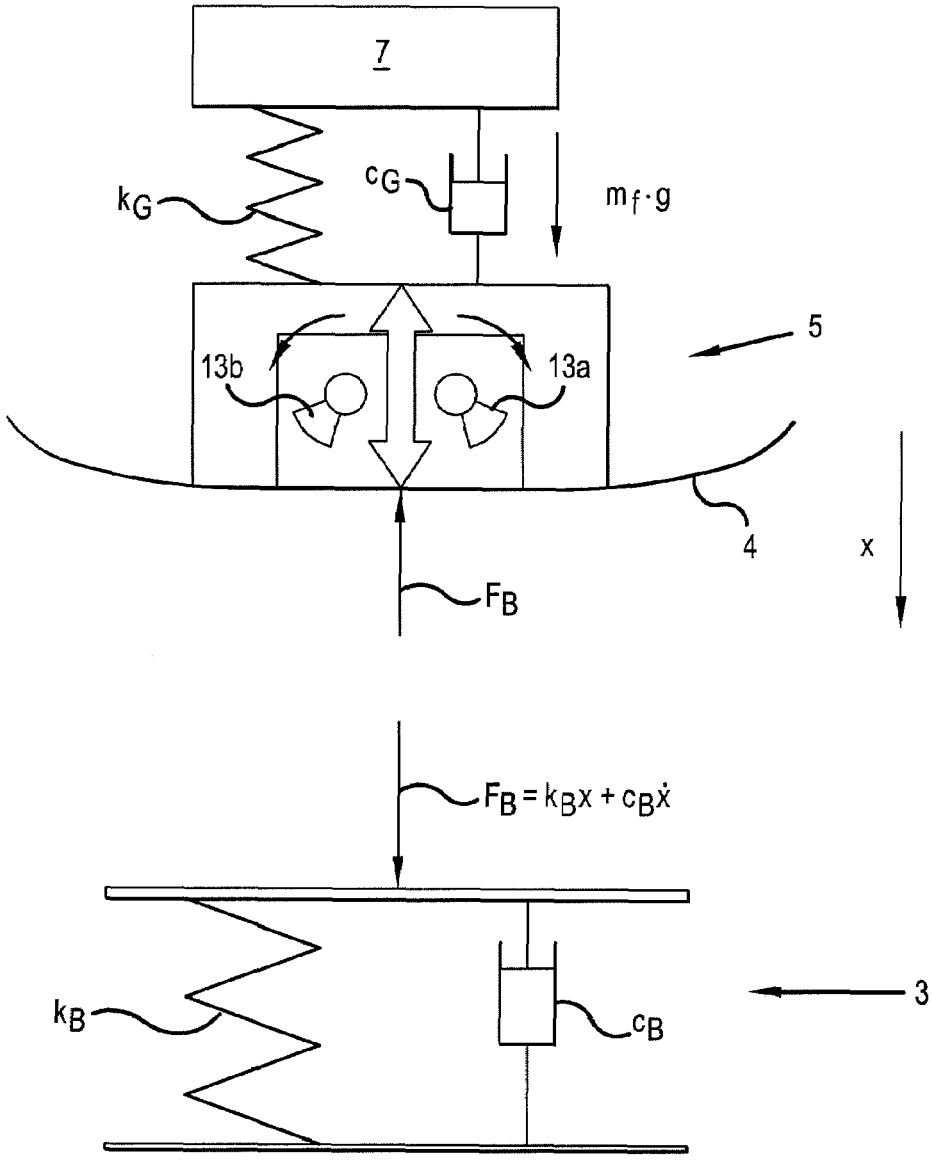
FIG. 3 shows an example of the excitation of a vibrating body as a vibration unit of a so-called vibration unit.

$F_B$ is the force acting on the soil area; see FIG. 3. This conventional second-order differential equation is rewritten to the two following first-order differential equations:

$$\dot{x}_1 = x_2 \tag{4b}$$

$$\dot{x}_2 = -\frac{F_B}{m_d} + A_0 \Omega^2 \cos(\Omega \cdot t) + \left(1 + \frac{m_d}{m_f}\right) \cdot g$$

$$\text{where } A_0 = \frac{M_d}{m_d}$$

and $$\begin{cases} F_B = c_B \dot{x}_d + k_B x & \text{for } F_B > 0 \quad \text{as the soil-force-} \\ F_B = 0 & \text{else} \quad \text{controlled-linearity} \end{cases}$$

In this case, the identity $x_2 \equiv \dot{x}$ applies.

A phase space representation with $x_1(t)-x_2(t)$, or $x(t)-\dot{x}(t)$ is derived from this.

The phase curves, also referred to as orbitals, are closed circles or ellipses in the case of linear, steady-state and monofrequency oscillations. In the case of non-linear oscillations in which harmonics additionally occur (the facing periodically lifts off the soil), the harmonics can be identified as modulated periodicities. The original circle mutates into closed curved systems, which have intersections in the phase space representation, only in the case of period doubling, that is to say subharmonic oscillations such as "jumping".

It has been found that the occurrence of subharmonic oscillations in the form of branches or bifurcations is a further central element of highly non-linear and chaotic oscillations. In contrast to harmonics, subharmonic oscillations represent a new operating state of a non-linear system which must be dealt with separately; this operating state differs to a major extent from the original, linear problem. This is because harmonics are small in comparison to the fundamental oscillation, that is to say the non-linear solution of the problem remains, in mathematical terms in the area of the solution of the linear system.

Figure 5:
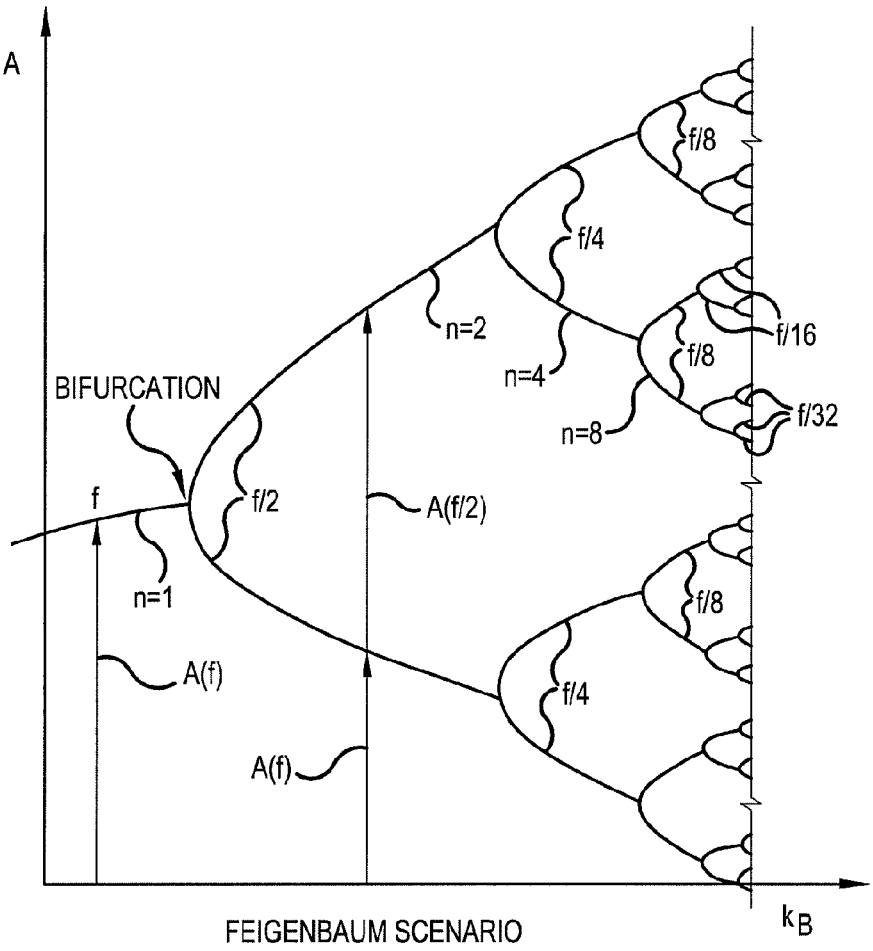
FIG. 5 shows a movement response of a vibration plate with the machine parameters remaining unchanged over a subsoil of different hardness.

Measured value recording is in practice initiated by the pulse from a Hall probe, which detects the zero crossing of the vibration wave. This also allows Poincaré images to be generated. If the periodically recorded amplitude values are plotted as a function of the varied system parameter, that is to say in our case the soil stiffness $k_B$, this results in the bifurcation or so-called Feigenbaum diagram of (FIG. 5). This diagram shows on the one hand the characteristic of the amplitudes which increase suddenly in the area of the branch as the stiffness rises, the tangent to the associated curve or curves runs vertically at the branch point. In consequence, no additional supply of energy is required to make the roller jump, in practice. The diagram also shows that further branches follow when the stiffness (compaction) rises, to be precise at ever shorter intervals with respect to the continuously increasing stiffness $k_B$. The branches produce a cascade of new oscillation components, each at half the frequency of the previously lowest frequency in the spectrum. Since the first branch splits off from the fundamental of the frequency f, or the period T, this results in the frequency cascade f, f/2, f/4, f/8, etc. Analogously to the fundamental, subharmonics also generate harmonics, and this results in a frequency continuum in the low-frequency region of the signal spectrum. This is likewise a specific characteristic of the chaotic system, that is to say of the vibrating vibration plate in the present case.

It is noted that the system of the compacting appliance is in a deterministic state, and not in a stochastic chaotic state. Since the parameters which result in the chaotic state cannot all be measured (they cannot be observed completely), the operating state of the subharmonic oscillations cannot be predicted for practical compaction. The operating behavior is in practice furthermore characterized by a large number of imponderables, the machine may slide away as a result of the major loss of contact with the soil, and the load on the machine may become very high as a result of the low-frequency oscillations. Further bifurcations of the machine behavior may occur (unexpectedly) at any time, immediately resulting in large additional loads. Large loads also occur between the facing and the soil; this leads to undesirable loosening of layers close to the surface, and results in grain destruction.

Thus, in the case of new appliances whose active machine parameters are actively controlled in the function of measured variables (for example, ACE: Ammann Compaction Expert), the unbalance and thus the energy supply are reduced immediately when the first subharmonic oscillation occurs at the frequency f/2. This measure reliably prevents the undesirable jumping or tumbling of the facing. Furthermore, force-control of the amplitude and frequency of the compaction appliance guarantees control of the non-linearity and thus reliable prevention of jumping/tumbling, which in fact in the end is the consequence of the non-linearity that occurs.

Owing to the fact that the subharmonic oscillations each represent a new motion state of the machine, relative measurements, for example for recording the compaction state of the soil, would have to be calibrated again for each newly occurring subharmonic oscillation, using the reference test procedure, such as the pressure plate test (DIN 18 196). This relative measurement can be dispensed with, as will be explained below.

In the case of a "Compactometer", in which the ratio of the first harmonic 2*f* to the fundamental f is used for compaction monitoring, the correlation fundamentally changes with the onset of jumping; a linear relationship between the measured value and the soil stiffness exists only within the respective branch state of the motion.

If the machine parameters are left constant, a cascade-like occurrence of bifurcations and harmonics with their respective doubling of the periods can be used analogously to large rollers as an indicator of increasing soil stiffness and compaction (relative compaction monitoring).

While rollers, from the roller system to hand-carried trench rollers, make use of the rolling movement of the facing for their onward movement and there is therefore no direct relationship between the vibration and the forward movement, the vibration plate always lifts off the soil periodically for its forward movement, controlled by the inclination of its directional oscillator. The vibrations and the forward movement are thus directly coupled to one another, and the plates and stampers in consequence always have the non-linear oscillation behavior. In consequence, as the stiffness $k_B$ increases, these appliances enter the area of the period doubling scenario more quickly, and chaotic operating states occur more frequently with them than in the case of rollers.

Figure 6:
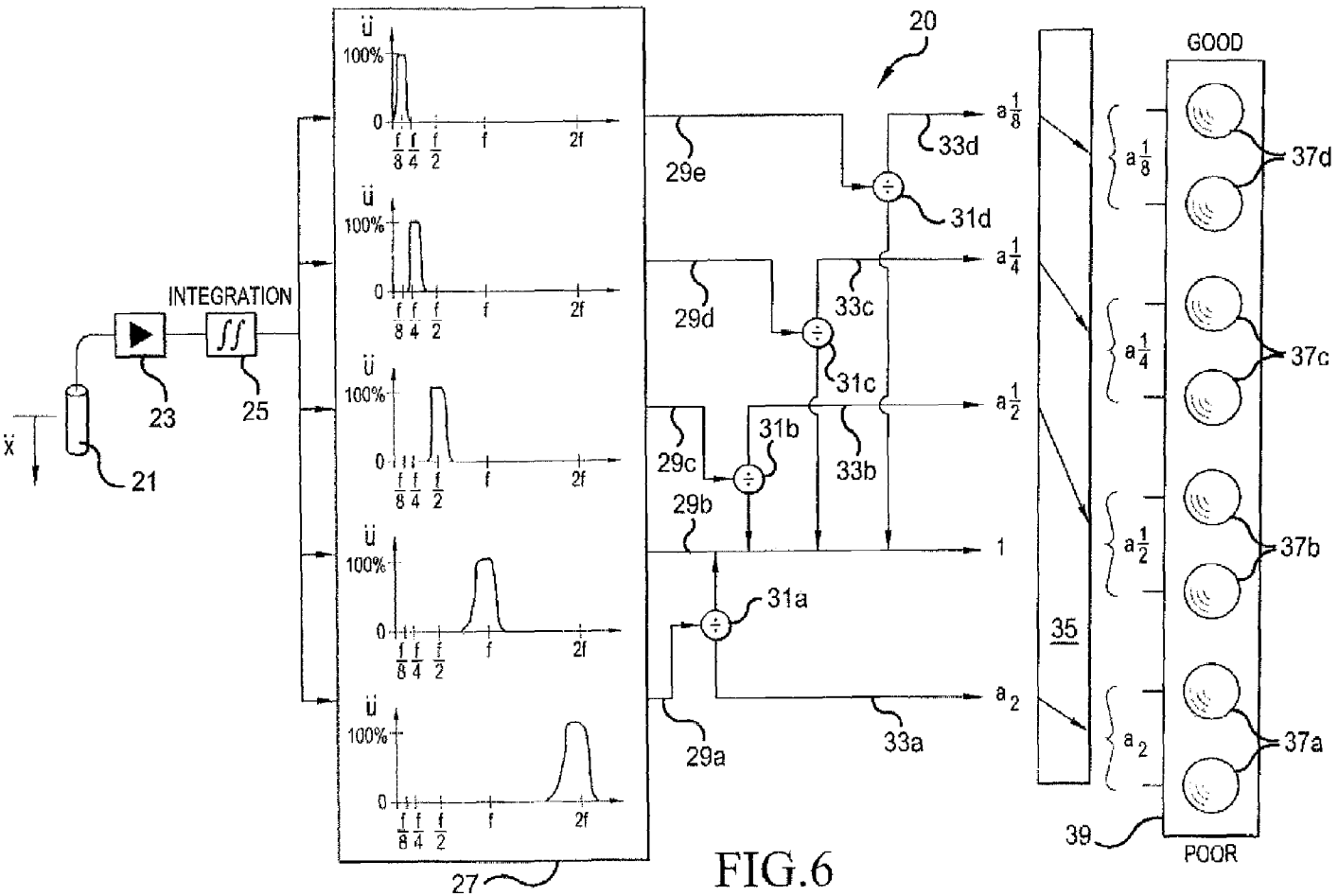
FIG. 6 shows a simple embodiment relating to the estimation of soil compaction, as can preferably be arranged on a vibration plate.

If the (exact) soil stiffness levels are dispensed with and if all that is desired as an indication to show whether the soil stiffness will rise if the apparatus is moved over the soil again, or has already reached a satisfactory level, the soil stiffness $k_B$ which has been achieved and/or determined by means of the vibration plate as described above can be greatly simplified and can thus be carried out at low cost using the following measurement apparatus 20, which is illustrated in FIG. 6. A measurement apparatus 20 such as this for a soil stiffness guideline value is mainly installed in vibration plates, whose cost is low in any case.

The oscillations of the vibrating body 5 are recorded by means of an acceleration sensor 21, are amplified by an amplifier 23, and are integrated over a predetermined time period by means of an integrator 25. The integration process is carried out in order to obtain a distance move, after double integration, from the acceleration value as measured by the acceleration sensor 21. The output signal from the integrator 25 is then passed to a plurality of bandpass filters 27. The bandpass filter is designed in such a way that, on the one hand, the excitation frequency f, the first harmonic at twice the excitation frequency 2·f, the first subharmonic at half the excitation frequency f/2, the second subharmonic at a quarter of the excitation frequency f/4 and the third subharmonic at one-eighth of the excitation frequency f/8 are each transferred into a respective output 29*a* to 29*e*. The measurement apparatus in this case, by way of example, has four divisors 31*a* to 31*d*, in order to monitor the frequencies 2·f, f, f/2, f/4 and f/8. The output 29*b* (output signal for f) is connected to all the dividers 31*a* to 31*d*, as the divisor. All of the outputs are connected to a respective divider 31*a* to 31*d*. The output 29*a* (output signal for 2·f) is connected as the dividend to the divider 31*a*, whose output signal (quotient) is produced at its output 33*a*. The output 33*a* is passed via a normalization circuit 35 to two lights 37*a* in a display panel 39.

The procedure for the outputs 29*c* (f/2), 29*d* (f/4), and 29*e* (f/8) is analogous and these are passed as the dividend to the dividers 31*b*, 31*c*, and 31*d*, respectively. A respective output 33*b*, 33*c*, or 33*d* of the divider 31*b*, 31*c*, or 31*d*, respectively, is passed via the normalization circuit 35 to two respective lights 37*b*, 37*c* and 37*d* in the display panel 39. If only the lights 37*a* illuminate, the relevant soil area has not yet been adequately compacted. If the lights 37*b* illuminate, better compaction has already been achieved, and in this case the compaction is then improved further until the lights 37*d* illuminate. If, by way of example, the lights 37*b* do not illuminate even when the vibration plate has been passed over the soil more than once, then further compaction is not possible, either because of the soil composition or the machine data of the vibration plate being used. An analogous situation applies to the lights 37*c* and 37*d*.

Instead of the two lights, it will be possible to use only a single light, if the aim is to indicate only the occurrence of the subharmonics. However, the measurement apparatus 20 not only determines the frequency response, but the maximum oscillation amplitudes of the individual oscillations (operating frequency f, harmonics n·f, subharmonics f/[2·n]) are also evaluated. In FIG. 5 ("Feigenbaum scenario") the amplitudes A(f) and A(f/2) of the operating frequency f and the first subharmonic f/2 are shown when the first subharmonic f/2 occurs for a specific state.

When an amplitude value that is predetermined by the normalization circuit 35 is reached, the respective second light in the light arrangement illuminates. The light intensity may, of course, also be controlled as a function of the amplitude level.

Instead of the bandpass filter 27, it is also possible to use a unit which carries out a (Fast Fourier Transformation FFT).

Instead of a bandpass filter 27, the respective oscillation amplitude can also be determined within time windows. In this case, always starting from the lowest position of the eccentric and with the speed of revolution being known, the amplitude values for the first harmonic and corresponding subharmonic are recorded, provided that they are available.

Figure 7:
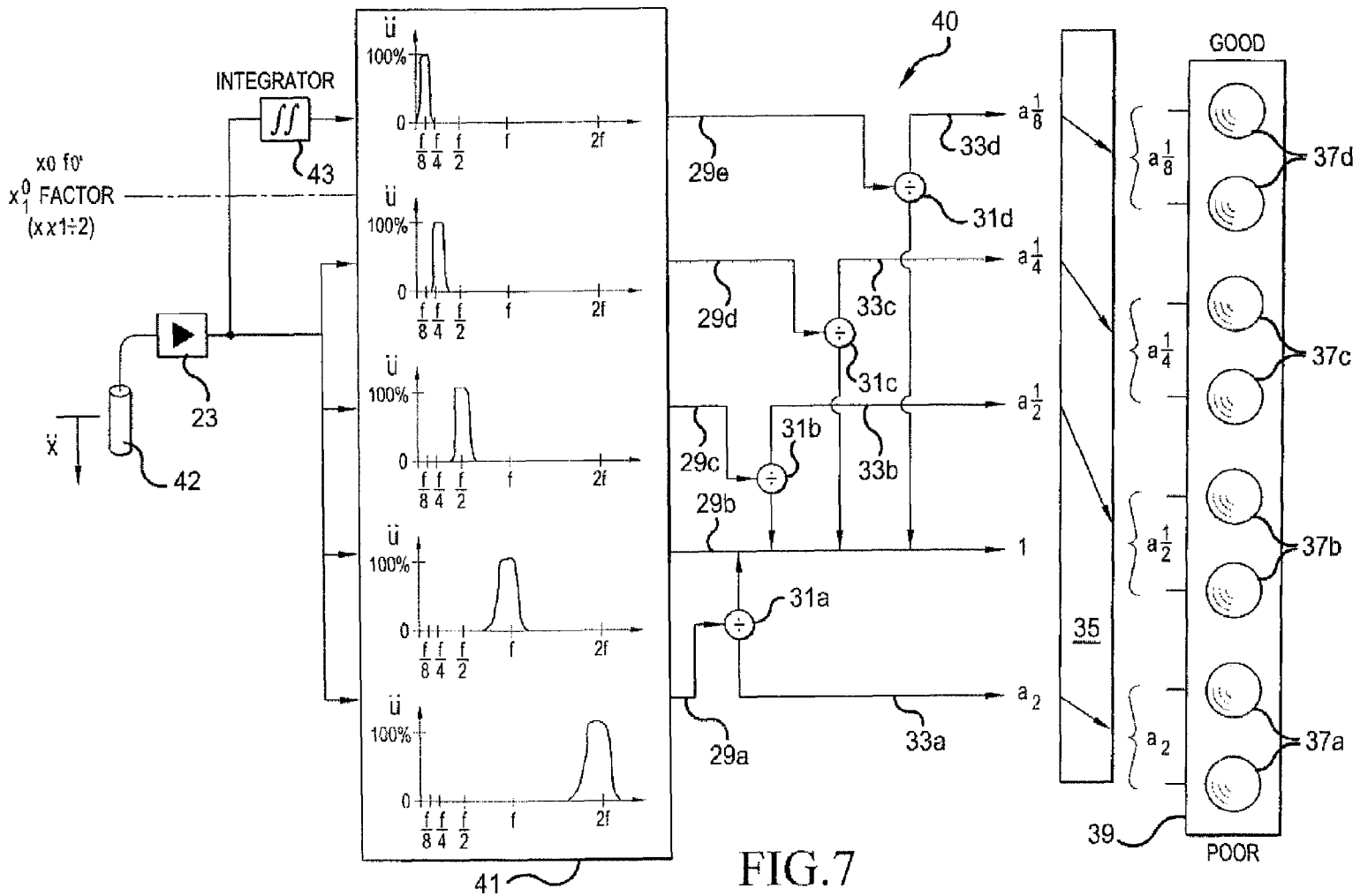
FIG. 7 shows a variant of the circuit illustrated in FIG. 6.

FIG. 7 shows a variant of the circuit illustrated in FIG. 6. In contrast to the circuit 20 in FIG. 6, an acceleration sensor 42 which is designed analogously to the acceleration sensor 21 is arranged in this circuit 40 on the dead weight body 7 of the vibration plate 1. Vibration damping is provided by means of damping elements (which are not illustrated) between the dead weight body and the vibrating body. The output signals from the acceleration sensor 42 for the first harmonic 2 f and the first and second subharmonics f/2 and f/4 are now not integrated, in contrast to the circuit 20, and processed as acceleration signals after amplification by the amplifier 23 and a bandpass filter 41. This is because the signals are generally sufficiently high. The signal for the third subharmonic f/8 is now integrated by means of an integrator 43 (because it is generally small), and is processed analogously to that in FIG. 5. There is no need to carry out the integration process only from the third subharmonic f/8. It is possible to integrate the second subharmonic f/4, or to integrate only the fourth subharmonic f/16.

The sensor for recording the oscillation form of the oscillating system is arranged on the vibrating body 5 or on the dead weight body 7, in accordance with the above description. If arranged on the dead weight body 7, oscillation influences can be observed through the damping elements, as outlined above.

In summary, it can be stated that the apparatus according to the invention, by means of which both a relative measurement and an absolute measurement of the soil compaction (soil stiffness) can be carried out, is designed such that it can be switched between these two states. The excitation frequency and/or the amount of unbalance are variable.

During the relative measurement of the soil compaction level, the vibration plate jumps. For this purpose:

- a high oscillation frequency (high speed of revolution of the unbalances) and
- a large unbalance are used, and
- the maximum unbalance vector is directed obliquely forwards or obliquely backwards, depending on the desired movement direction with respect to the soil.

In the case of the absolute measurement of the soil compaction (soil stiffness), the vibration plate remains at the measurement location (surcharge mode). This is dependent on:

- a low oscillation frequency
- a small unbalance and
- a maximum unbalance vector which is at right angles to the soil surface.

The relative measurement described above is a very fast method for determination of the compaction level of a compacted surface (while the soil has already been compacted well and where it is still poorly compacted). It is carried out only over the soil surface, and the compaction level is indicated. A-recording can also be made in an associated coordinate grid. This coordinate grid can be predetermined by means of GPS or other triangulation methods.

The vibration plate in accordance to the invention with the selective or automatic changeover as described above between relative measurement and absolute measurement of the soil compaction represents a low-cost compaction monitoring means integrated with the work. It is possible to find out on a predetermined soil section whether

- the compaction has increased and
- the compaction is homogeneous.

It is also possible to determine the absolute soil stiffnesses. The building site manager or the customer can himself check whether the required compaction levels have been achieved.

As already stated above, the vibration frequency, the unbalance amplitude and the phase angle between excitation and oscillation response can be varied with the vibration plate according to the invention. It is thus possible to produce a controlled vibration plate with which

- optimum compaction can be achieved automatically,
- the number of passes with the vibration plate can be minimized, and
- the compaction can be checked over an area, and
- the oscillations which are transmitted to the arm of the vibration plate operator can be greatly reduced, and
- the frequency and unbalance amplitude can be matched to the respective ground underneath (⇨ optimum compaction process) on the basis of the measured values, and
- the life of the machine can be extended since damaging frequencies and amplitudes are identified, and can be changed immediately to values that do not cause damage.

The invention claimed is:

1. A method for determination of soil stiffness levels of a soil area, whereas one and the same self-propelled apparatus (1) is used not only to determine the absolute soil stiffness level ($k_B$) when located on at least one predetermined soil subarea (3) of the soil area but also to determine a plurality of relative soil stiffness levels(s) while crossing over a plurality of soil subareas of the soil area, comprising:

in order to determine an absolute soil stiffness level ($k_B$), moving a vibration unit (5) of the apparatus (1) into a predetermined soil subarea (3), and a first time-variable excitation force being produced as a periodic first force with a maximum first oscillation level, which is directed at right angles (with the exception of an adjustment tolerance) against the soil surface, is applied by means of the vibration unit (5) in permanent contact with the soil surface, whereas the vibration unit (5) and the predetermined soil subarea (3) represent a single oscillating system, and first data items of a first oscillation response of the oscillating system and second data items of the first time-variable excitation force are determined, and an absolute soil stiffness level ($k_B$) of the predetermined soil subarea (3) is determined from the first and second data items; and in order to determine a plurality of relative soil stiffness levels(s) of a plurality of soil subareas, moving the vibration unit (5) to the soil surface of one of the soil subarea of the soil area, whereas a second time-variable excitation force acts on the vibration unit (5) in such a way that the vibration unit (5) is lifted off the soil surface (2) and can thus be moved in a jumping manner to a plurality of the soil subarea, whereas third data items representing a lowest subharmonic frequency of a second oscillation response of the oscillation of the vibration unit (5), caused by the second excitation force, and fourth data items representing the oscillation of the second excitation force are determined, and relative soil stiffness levels ($k_B$) of the soil subareas are determined successively and continuously over the soil area from the third and fourth data items.

2. The method as claimed in claim 1, characterized in that the periodicity is adjusted in such a manner that the oscillating system is at resonance, and the first and the second data items include the resonant frequency and a phase angle between a time sequence of maximum oscillation values of the first excitation force and of the first oscillation response.

3. The method as claimed in claim 2, characterized in that the second time-variable excitation force is produced with a second periodic force, the second force has a maximum oscillation level which is greater than a first maximum oscillation level of a first periodic force of the first excitation force in such a way that the vibration unit (5) is lifted off the soil surface (2), in which case the second maximum oscillation level of the second periodic force is directed obliquely to the rear with respect to the vibration unit towards the soil surface (2), in order that the vibration unit (5) can be moved in the forward direction, and a lowest determined subharmonic frequency is determined, as the third data items of the second oscillation response, as a measure for a relative soil stiffness(s) with a relative soil stiffness(s) becoming greater, the lower the lowest determined subharmonic oscillation is.

4. The method as claimed in claim 2, characterized in that the amplitudes of a first harmonic and of subharmonics during periodic excitation of the vibration unit (5) by the second excitation force are determined as third data items of the second oscillation response, preferably third data items are determined in soil subareas, which are located at different points, in a soil area together with the relevant absolute values, and are stored in order to carry out a calibration process which allows measured relative values to be represented as absolute values, in which case the soil area has the same soil composition, except for a tolerance, the amplitude values of the third data items with respect to the maximum oscillation level of the excitation oscillation with individual weighting factors to be determined forming a sum, in which case the sum value is the respective location-specific absolute value, and the individual weighting factors are determined from a plurality of measurements, in which case the number of measurements corresponds to the number of weighting factors, and in which case the magnitude of the sum after a calibration process is a measure of an absolute soil compaction level or of an absolute soil stiffness of a soil subarea which is just been moved over.

5. The method as claimed in claim 2, characterized in that the second force, which is greater than a first maximum oscillation level of a periodic force of the first excitation force, is set in that at least one unbalance revolves, and preferably at least two unbalances revolve in opposite directions, and in particular two unbalances revolve in opposite directions with a mutual position offset, and their speed of revolution is correspondingly increased.

6. The method as claimed in claim 2, characterized in that the second force, which is greater than a first maximum oscillation level of a periodic force of the first excitation force, is set in that at least one unbalance revolves, and the mass distribution of at least one unbalance is varied radially and, except for soil tolerances, a periodicity of the second excitation force preferably corresponds to a resonant frequency of the oscillating system.

7. The method as claimed in claim 1, characterized in that the second time-variable excitation force is produced with a second periodic force, the second force has a maximum oscillation level which is greater than a first maximum oscillation level of a first periodic force of the first excitation force in such a way that the vibration unit (5) is lifted off the soil surface (2), in which case the second maximum oscillation level of the second periodic force is directed obliquely to the rear with respect to the vibration unit towards the soil surface (2), in order that the vibration unit (5) can be moved in the forward direction, and in such a way that relative soil stiffness level(s) is becoming greater, the lower the lowest determined subharmonic oscillation is.

8. The method as claimed in claim 7, characterized in that the amplitudes of a first harmonic and of subharmonics during periodic excitation of the vibration unit (5) by the second excitation force are determined as third data items of the second oscillation response, preferably third data items are determined in soil subareas, which are located at different points, in a soil area together with the relevant absolute values, and are stored in order to carry out a calibration process which allows measured relative values to be represented as absolute values, in which case the soil area has the same soil composition, except for a tolerance, the amplitude values of the third data items with respect to the maximum oscillation level of the excitation oscillation with individual weighting factors to be determined forming a sum, in which case the sum value is the respective location-specific absolute value, and the individual weighting factors are determined from a plurality of measurements, in which case the number of measurements corresponds to the number of weighting factors, and in which case the magnitude of the sum after a calibration process is a measure of an absolute soil compaction level or of an absolute soil stiffness of a soil subarea which is just been moved over.

9. The method as claimed in claim 7, characterized in that the second force, which is greater than a first maximum oscillation level of a periodic force of the first excitation force, is set in that at least one unbalance revolves, and preferably at least two unbalances revolve in opposite directions, and in particular two unbalances revolve in opposite directions with a mutual position offset, and their speed of revolution is correspondingly increased.

10. The method as claimed in claim 1, characterized in that the amplitudes of a first harmonic and of subharmonics during periodic excitation of the vibration unit (5) by the second excitation force are determined as third data items of the second oscillation response, preferably third data items are determined in soil subareas, which are located at different points, in a soil area together with the relevant absolute values, and are stored in order to carry out a calibration process which allows measured relative values to be represented as absolute values, in which case the soil area has the same soil composition, except for a tolerance, the amplitude values of the third data items with respect to the maximum oscillation level of the excitation oscillation with individual weighting factors to be determined forming a sum, in which case the sum value is the respective location-specific absolute value, and the individual weighting factors are determined from a plurality of measurements, in which case the number of measurements corresponds to the number of weighting factors, and in which case the magnitude of the sum after a calibration process is a measure of an absolute soil compaction level or of an absolute soil stiffness of a soil subarea which is just been moved over.

11. The method as claimed in claim 10, characterized in that the second force, which is greater than a first maximum oscillation level of a periodic force of the first excitation force, is set in that at least one unbalance revolves, and preferably at least two unbalances revolve in opposite directions, and in particular two unbalances revolve in opposite directions with a mutual position offset, and their speed of revolution is correspondingly increased.

12. The method as claimed in claim 1, characterized in that the second force, which is greater than a first maximum oscillation level of a periodic force of the first excitation force, is set in that at least one unbalance revolves, and preferably at least two unbalances revolve in opposite directions, and in particular two unbalances revolve in opposite directions with a mutual position offset, and their speed of revolution is correspondingly increased.

13. The method as claimed in claim 1, characterized in that the second force, which is greater than a first maximum oscillation level of a periodic force of the first excitation force, is set in that at least one unbalance revolves, and the mass distribution of at least one unbalance is varied radially and, except for soil tolerances, a periodicity of the second excitation force preferably corresponds to a resonant frequency of the oscillating system.

14. The method as claimed in claim 1, characterized in that respective position coordinates of a soil subarea are determined for relative or absolute soil stiffness levels, the values of the soil stiffness are stored, in particular together with the position coordinates, and are transmitted, preferably to a control center, in which case, in particular, the relative values of the soil stiffness are stored together with a predetermined positional coordinate grid.

15. The method as claimed in claim 1, characterized in that a resonant frequency of the oscillating system formed from the vibration unit and the soil area is determined and the first and second data comprise the resonant frequency and a phase angle between the occurrence of a maximum oscillation value of the first excitation force and a maximum oscillation value of the first oscillation response of the oscillating system.

16. An apparatus which propels itself on a soil surface for determination of soil stiffness levels of a soil area having a vibration unit being part of a so-called vibration plate, which can be moved into contact with the soil surface, whereas the vibration unit (5) can preferably also be used for soil compaction, comprising:

a vibration plate having a force production unit by means of which a periodic first excitation force and a second excitation force, which is not the same as the first and which act on the vibration unit (5), can be produced, whereas the first excitation force can be adjusted by means of the force production unit in such a way that a maximum oscillation amplitude of the first excitation force can be directed at right angles against the soil surface, whereas the period of the first excitation force can be adjusted in such a way that resonance of an oscillating system formed from the vibration unit and a predetermined soil subarea of the soil area can be achieved, and the vibration unit (5) never loses contact with the soil subarea of the soil area under the influence of the first excitation force, and whereas the second excitation frequency can be adjusted by means of the force production unit in such a way that the maximum oscillation amplitude of the second excitation force can be directed obliquely with respect to the soil surface and the excitation force is sufficiently large than the vibration unit loses soil contact in a jumping manner;

a measuring device with which oscillation data of the excitation force as well as oscillation data of the vibration unit can be determined as an oscillation response; and an evaluation unit by means of which at least one absolute value of a soil stiffness of a predetermined soil subarea can be determined by means of the first excitation force from the oscillation data of the excitation force and the data of an oscillation response of the vibration unit (5), whereas a plurality of relative values of soil stiffnesses of predetermined soil subareas of the soil area can be determined by means of the second excitation force.

17. The apparatus as claimed in claim 16, characterized in that the vibration unit (5) has an adjustable steady-state unbalance moment and/or an adjustable excitation frequency for at least one rotating unbalance, in order that relative soil stiffness levels can be determined with a first unbalance moment and/or at a first excitation frequency, preferably together with soil compaction, and absolute soil stiffness levels can be determined with a second unbalance moment, which is not same as the first unbalance moment and/or at a second excitation frequency, which is not the same as the first excitation frequency, and soil compaction can be carried out with a third unbalance moment, which is not the same as the first or second unbalance moment, and/or at a third excitation frequency, which is not the same as the first or second excitation frequency.

18. The apparatus as claimed in claim 16, characterized in that the first or second unbalance moment can be produced by two unbalances which revolve in opposite directions but at the same rotation speed, in which case the rotation speed can be adjusted in order to produce different excitation frequencies.

19. The apparatus as claimed in claim 16, characterized by indication means, by means of which compaction levels can be indicated, in order to find out whether a compaction increase which exceeds a predetermined tolerance can still be achieved by further passes.

20. The apparatus as claimed in claim 16, characterized in that the measurement means has a data memory, an evaluation unit and a position detection unit for determination of position coordinates of a soil area on which the apparatus is currently located, in which case the determined relative and absolute soil stiffness levels can be stored in the data memory, preferably together with the associated position coordinates, and soil-specific weighting values, which can be stored in the data memory, can be determined from stored soil stiffness levels by the evaluation unit, in which case the relative values of the soil stiffness can be converted to absolute values by means of the weighting values, and a transmission unit is preferably provided, by means of which these stored data items can be transmitted to a control center and, in particular, the apparatus has an indicator for the absolute values and preferably for the relative values.

21. A method for determination of soil stiffness levels of a soil area, in which case one and the same self-propelled apparatus (1) is used not only to determine the absolute soil stiffness level ($k_B$) when located on at least one predetermined soil subarea (3) of the soil area but also to determine a plurality of relative soil stiffness levels(s) while crossing over a plurality of soil subareas of the soil area, comprising:

moving a vibration unit (5) into a predetermined soil subarea (3), in order to determine an absolute soil stiffness level ($k_B$), a first time-variable excitation force is applied by means of the vibration unit (5) in permanent contact with the soil surface, whereas the vibration unit (5) and the predetermined soil subarea (3) represent a single oscillating system, and first data items of a first oscillation response of the oscillating system and second data items of the first time-variable excitation force are determined, and an absolute soil stiffness level ($k_B$) of the predetermined soil subarea (3) is determined from the first and second data items; and moving the vibration unit (5) to the soil of one of the soil subarea of the soil area, in order to determine a plurality of relative soil stiffness levels(s) of a plurality of soil subarea, a second time-variable excitation force acts on the vibration unit (5) in such a way that the vibration unit (5) is lifted off the soil surface (2) and can thus be moved in a jumping manner to a plurality of the soil subareas, third data items of a second oscillation response of the oscillation of the vibration unit (5), caused by the second excitation force, and fourth data items of the oscillation of the second excitation force are determined, and relative soil stiffness levels ($k_B$) of the soil subarea are determined successively and continuously over the soil area from the third and fourth data items, whereas the amplitude of the first harmonic and of subharmonics during periodic excitation of the vibration unit (5) by the second excitation force are determined as third data items of the second oscillation response, preferably third data items are determined in soil subarea, which are located at different points, in a soil area together with the relevant absolute values, and are stored in order to carry out a calibration process which allows measured relative values to be represented as absolute values, whereas the soil area has the same soil composition, except for a tolerance, the amplitude values of the third data items with respect to the maximum oscillation level of the excitation oscillation with individual weighting factors to be determined forming a sum, whereas the sum value is the respective location-specific absolute value, and the individual weighting factors are determined from a plurality of measurements, and whereas the numbers of measurements corresponds to the number of weighting factors, and the magnitude of the sum after a calibration process is a measure of an absolute soil compaction level or of an absolute soil stiffness of a soil subarea which is just been moved over.

22. A method for determination of soil stiffness levels of a soil area, in which case one and the same self-propelled apparatus (1) is used not only to determine the absolute soil stiffness level ($k_B$) when located on at least one predetermined soil subarea (3) of the soil area but also to determine a plurality of relative soil stiffness levels(s) while crossing over a plurality of soil subareas of the soil area, comprising:

moving a vibration unit (5) into a predetermined soil subarea (3), in order to determine an absolute soil stiffness level ($k_B$), a first time-variable excitation force is applied by means of the vibration unit (5) in permanent contact with the soil surface, whereas the vibration unit (5) and the predetermined soil subarea (3) represent a single oscillating system, and first data items of a first oscillation response of the oscillating system and second data items of the first time-variable excitation force are determined, and an absolute soil stiffness level ($k_B$) of the predetermined soil subarea (3) is determined from the first and second data items; and moving the vibration unit (5) to the soil surface of one of the soil subarea of the soil area, in order to determine a plurality of relative soil stiffness levels(s) of a plurality of soil subareas, a second time-variable excitation force acts on the vibration unit (5) in such a way that the vibration unit (5) is lifted off the soil surface (2) and can thus be moved in a jumping manner to a plurality of the soil subareas, third data items of a second oscillation response of the oscillation of the vibration unit (5), caused by the second excitation force, and fourth data items of the oscillation of the second excitation force are determined, and relative soil stiffness levels ($k_B$) of the soil subarea are determined successively and continuously over the soil area from the third and fourth data items, whereas the first time-variable excitation force is produced as a periodic first force with a maximum first oscillation level, which is directed at right angles (with the exception of an adjustment tolerance) against the soil surface (2), and the periodicity is adjusted in such a manner that the oscillating system is at resonance, and the first and second data items include the resonant frequency and a phase angle between a time sequence of maximum oscillation values of the first excitation force and of the first oscillation response, whereas the amplitude of the first harmonic and of subharmonics during periodic excitation of the vibration unit (5) by the second excitation force are determined as third data items of the second oscillation response, preferably third data items are determined in soil subareas, which are located at different points, in a soil area together with the relevant absolute values, and are stored in order to carry out a calibration process which allows measured relative values to be represented as absolute values, whereas the soil area has the same soil composition, except for a tolerance, the amplitude values of the third data items with respect to the maximum oscillation level of the excitation oscillation with individual weighting factors to be determined forming a sum, whereas the sum value is the respective location-specific absolute value, and the individual weighting factors are determined from a plurality of measurements, and whereas the numbers of measurements corresponds to the number of weighting factors, and the magnitude of the sum after a calibration process is a measure of an absolute soil compaction level or of an absolute soil stiffness of a soil subarea which is just been moved over.

23. A method for determination of soil stiffness levels of a soil area, in which case one and the same self-propelled apparatus (1) is used not only to determine the absolute soil stiffness level ($k_B$) when located on at least one predetermined soil subarea (3) of the soil area but also to determine a plurality of relative soil stiffness levels(s) while crossing over a plurality of soil subareas of the soil area, comprising:

moving a vibration unit (5) into a predetermined soil subarea (3), in order to determine an absolute soil stiffness level ($k_B$), a first time-variable excitation force is applied by means of the vibration unit (5) in permanent contact with the soil surface, whereas the vibration unit (5) and the predetermined soil subarea (3) represent a single oscillating system, and first data items of a first oscillation response of the oscillating system and second data items of the first time-variable excitation force are determined, and an absolute soil stiffness level ($k_B$) of the predetermined soil subarea (3) is determined from the first and second data items; and moving the vibration unit (5) to the soil surface of one of the soil subarea of the soil area, in order to determine a plurality of relative soil stiffness levels(s) of a plurality of soil subareas, a second time-variable excitation force acts on the vibration unit (5) in such a way that the vibration unit (5) is lifted off the soil surface (2) and can thus be moved in a jumping manner to a plurality of the soil subareas, third data items of a second oscillation response of the oscillation of the vibration unit (5), caused by the second excitation force, and fourth data items of the oscillation of the second excitation force are determined, and relative soil stiffness levels ($k_B$) of the soil subarea are determined successively and continuously over the soil area from the third and fourth data items, whereas the second time-variable excitation force is produced with a second periodic force, the second force has a maximum oscillation level which is greater than a first maximum oscillation level of a first periodic force of the first excitation force in such a way that the vibration unit (5) is lifted off the soil surface (2), whereas the second maximum oscillation level of the second periodic force is directed obliquely to the rear with respect to the vibration unit towards the soil surface (20, in order that the vibration unit (5) can be moved in the forward direction, and a lowest determined subharmonic frequency is determined, as the third data items of the second oscillation response, as a measure for a relative soil stiffness(s) with a relative soil stiffness(s) becoming greater, the lower of the lowest determined subharmonic oscillation is, whereas the amplitude of the first harmonic and of subharmonics during periodic excitation of the vibration unit (5) by the second excitation force are determined as third data items of the second oscillation response, preferably third data items are determined in soil subarea, which are located at different points, in a soil area together with the relevant absolute values, and are stored in order to carry out a calibration process which allows measured relative values to be represented as absolute values, whereas the soil area has the same soil composition, except for a tolerance, the amplitude values of the third data items with respect to the maximum oscillation level of the excitation oscillation with individual weighting factors to be determined forming a sum, whereas the sum value is the respective location-specific absolute value, and the individual weighting factors are determined from a plurality of measurements, and whereas the numbers of measurements corresponds to the number of weighting factors, and the magnitude of the sum after a calibration process is a measure of an absolute soil compaction level or of an absolute soil stiffness of a soil subarea which is just been moved over.

* * * * *